US007102572B2

(12) United States Patent
Okado

(10) Patent No.: US 7,102,572 B2
(45) Date of Patent: Sep. 5, 2006

(54) ANTENNA AND WIRELESS COMMUNICATION CARD

(75) Inventor: Hironori Okado, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/655,304

(22) Filed: Sep. 5, 2003

(65) Prior Publication Data

US 2004/0100407 A1 May 27, 2004

(30) Foreign Application Priority Data

Nov. 27, 2002 (JP) ..... 2002-343290
Mar. 4, 2003 (JP) ..... 2003-056740
May 28, 2003 (JP) ..... 2003-150376

(51) Int. Cl.
*H01Q 1/38* (2006.01)
*H01Q 1/48* (2006.01)

(52) U.S. Cl. ..... 343/700 MS; 343/846

(58) Field of Classification Search ..... 343/700 MS, 343/795, 767, 846
See application file for complete search history.

(56) References Cited

U.S. PATENT DOCUMENTS 4,083,046 A 4/1978 Kaloi
4,151,531 A 4/1979 Kaloi
4,151,532 A 4/1979 Kaloi
4,500,887 A 2/1985 Nester
4,605,012 A 8/1986 Ringeisen et al.
4,605,933 A 8/1986 Butscher
5,255,002 A 10/1993 Day
5,521,606 A 5/1996 Iijima et al.
5,532,707 A 7/1996 Klinger
5,847,682 A 12/1998 Ke
5,872,546 A 2/1999 Ihara et al.
6,046,703 A * 4/2000 Wang et al. ..... 343/795
6,097,345 A 8/2000 Walton
6,133,879 A 10/2000 Grangeat et al.
6,157,344 A 12/2000 Bateman
6,232,925 B1 5/2001 Fujikawa
6,249,254 B1 6/2001 Bateman (Continued)

FOREIGN PATENT DOCUMENTS

EP 0 831 548 A2 3/1998

(Continued)

OTHER PUBLICATIONS

Satoshi Honda et al.; Wideband Monopole Antenna of Circular Disc; ITEJ Technical Report; vol. 15, NO. 59; Oct. 1991; pp. 25-30.

(Continued)

*Primary Examiner*—Don Wong
*Assistant Examiner*—Hung Tran Vy
(74) *Attorney, Agent, or Firm*—Oliff & Berridge, PLC

(57) ABSTRACT

An antenna of this invention comprises an antenna element to which power is fed at a feed point; and a ground pattern that is juxtaposed with the antenna element and in which a tapered shape is formed with respect to the feed point of the antenna element. By providing the tapered shape for the ground pattern, it is possible to appropriately adjust the coupling degree with the antenna element, thereby it is possible to widen the bandwidth. Moreover, since the ground pattern and the antenna element are juxtaposed with each other, miniaturization can be achieved. When the antenna element is integrally formed in a dielectric substrate, further miniaturization can be achieved. Furthermore, when a cut-out portion is formed in the antenna element, the characteristic of the antenna in the low frequency range is improved.

18 Claims, 13 Drawing Sheets

U.S. PATENT DOCUMENTS

| | | | | |
|---|---|---|---|---|
| 6,259,416 | B1 * | 7/2001 | Qi et al. | 343/767 |
| 6,329,950 | B1 | 12/2001 | Harrell et al. | |
| 6,351,246 | B1 | 2/2002 | McCorkle | |
| 6,452,548 | B1 | 9/2002 | Nagumo et al. | |
| 6,515,626 | B1 | 2/2003 | Bark et al. | 343/795 |
| 6,603,429 | B1 * | 8/2003 | Bancroft et al. | 343/700 MS |
| 6,707,427 | B1 * | 3/2004 | Konishi et al. | 343/700 MS |
| 6,720,924 | B1 * | 4/2004 | Tomomatsu et al. | 343/700 MS |
| 6,747,600 | B1 * | 6/2004 | Wong et al. | 343/700 MS |
| 6,747,605 | B1 * | 6/2004 | Lebaric et al. | 343/795 |
| 6,762,723 | B1 * | 7/2004 | Nallo et al. | 343/700 MS |
| 6,768,461 | B1 | 7/2004 | Huebner et al. | |
| 2002/0015000 | A1 * | 2/2002 | Reece et al. | 343/795 |
| 2002/0026586 | A1 | 2/2002 | Ito | |
| 2002/0122010 | A1 | 9/2002 | McCorkle | 343/767 |
| 2003/0020668 | A1 | 1/2003 | Peterson | |
| 2003/0034920 | A1 | 2/2003 | Lee | |
| 2003/0156064 | A1 * | 8/2003 | Bancroft et al. | 343/700 MS |

FOREIGN PATENT DOCUMENTS

| | | |
|---|---|---|
| EP | 1 198 027 A1 | 4/2002 |
| JP | 31-709 | 1/1956 |
| JP | A 55-4109 | 1/1980 |
| JP | A 57-142003 | 9/1982 |
| JP | A 63-275204 | 11/1988 |
| JP | U 5-76109 | 10/1993 |
| JP | JU-A-5-82122 | 11/1993 |
| JP | A 06-291530 | 10/1994 |
| JP | U 3008389 | 12/1994 |
| JP | A 8-213820 | 8/1996 |
| JP | A 09-223921 | 8/1997 |
| JP | A 11-27026 | 1/1999 |
| JP | A 2001/156532 | 6/2001 |
| JP | A 2001-203529 | 7/2001 |
| JP | A 2001-217632 | 8/2001 |
| JP | A 2001-217643 | 8/2001 |
| JP | A 2002-077999 | 3/2002 |
| JP | A 2002-100915 | 4/2002 |
| JP | A 2002-171126 | 6/2002 |
| JP | A 2002-252515 | 9/2002 |
| JP | A 2002-319811 | 10/2002 |

OTHER PUBLICATIONS

Taisuke Ihara et al; "A Small Broadband Antenna with Rounded Semi-Circular Element"; 1996; pp. 78, no month.

Taisuke Ihara et al; "Broadband Characteristics of Semi-Circuler Antenna combined with Linear Element"; General Convention of the Society of Electronics, Information and Comunication Engineers; 1996; pp. 77 w/translation, no month.

Satoshi Honda et al; Improved Input Impedance of Circular Disc Monopole Antenna; 1992; pp. 2-131, no month.

John D. Kraus, "Antennas", 2nd edition 1988 McGraw-Hill, pp. 346-347 and pp. 723-725.

"Antenna Engineering Handbook", Electronic Information Communication Institution, p. 128, no date & month.

* cited by examiner

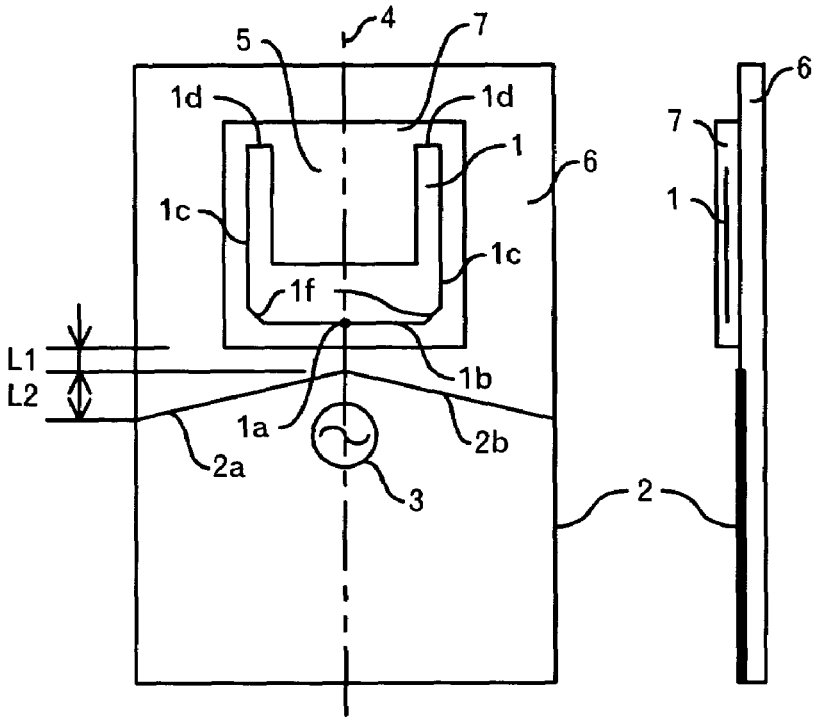
FIG.1A
FIG.1B
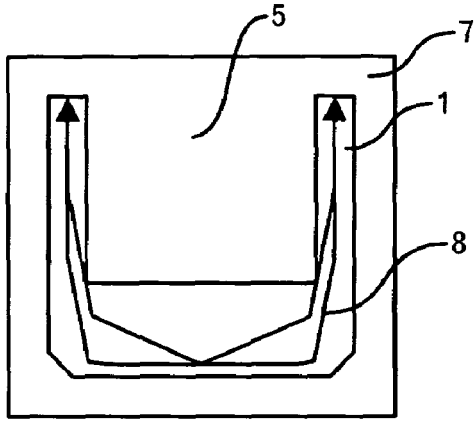
FIG.2

ANTENNA AND WIRELESS COMMUNICATION CARD

TECHNICAL FIELD OF THE INVENTION

The present invention relates to a wide bandwidth antenna and a communication card using the wide bandwidth antenna.

BACKGROUND OF THE INVENTION

For example, JP-A-57-142003 discloses the following antennas. That is, it discloses a monopole antenna in which a flat-plate type radiation element 1001 having a disc shape is erected vertically to an earth plate or the ground 1002 as shown in FIGS. 16A-1 and 16A-2. This monopole antenna is designed so that a high-frequency power source 1004 and the radiation element 1001 are connected to each other through a power feeder 1003 and the height of the top portion of the radiation element 1001 is set to a quarter wavelength. Furthermore, it also discloses a monopole antenna in which a flat-plate type radiation element 1005 whose upper peripheral edge portion has a shape extending along a predetermined parabola is erected vertically to an earth plate or the ground 1002. Still furthermore, it discloses a dipole antenna in which two radiation elements 1001 of the monopole antenna shown in FIGS. 16A-1 and 16A-2 are symmetrically arranged as shown in FIG. 16C. Still furthermore, it discloses a dipole antenna in which two radiation elements 1005 of the monopole antenna shown in FIG. 16B-1 and 16B-2 are symmetrically arranged as shown in FIG. 16D.

In addition, JP-A-55-4109 discloses the following antennas, for example. That is, a sheet-type elliptical antenna 1006 is erected vertically to a refection surface 1007 so that the major axis thereof is parallel to the reflection surface 1007, and power supply is carried out through a coaxial power feeder 1008, as shown in FIG. 16E. FIG. 16F shows an example where the antenna is configured as a dipole. In the case of the dipole type, the sheet-type elliptical antennas 1006*a* are arranged on the same plane so that the minor axes thereof are located on the same line, and a slight gap is disposed so that a balanced feeder 1009 is connected to both the antennas.

Besides, a monopole antenna as shown in FIG. 16G is disclosed in "B-77: BROADBAND CHARACTERISTICS OF SEMI-CIRCULAR ANTENNA COMBINED WITH LINEAR ELEMENT", Taisuke Ihara, Makoto Kijima and Koichi Tsunekawa, pp77 General Convention of The Institute of Electronics, Information and Communication Engineers, 1996 (hereinafter referred to as "non-patent document 1"). As shown in FIG. 16G, a semicircular element 1010 is erected vertically to an earth plate 1011, and the nearest point of the arc of the element 1010 to the earth plate 1011 serves as a feed portion 1012. The non-patent document 1 shows that the frequency $f_L$ at which the radius of the circle almost corresponds to a quarter wavelength is the lower limit. Furthermore, it also describes an example where an element 1013 achieved by forming a cut-out portion in the element 1010 shown in FIG. 16G is erected vertically to the earth plate 1011 as shown in FIG. 16H, and that little difference exists in VSWR (Voltage Standing Wave Ratio) characteristic between the monopole antenna shown in FIG. 16G and the monopole antenna shown in FIG. 16H. Furthermore, it also discloses an example where an element 1014, which is formed by connecting an element 1014*a*, which resonates at $f_L$ or less and has a meander monopole structure, to an element with the cut-out portion as shown in FIG. 16H, is erected vertically to the earth plate 1011 as shown in FIG. 16I. Incidentally, the element 1014*a* is disposed to be accommodated in the cut-out portion. The antenna resonates at a frequency lower than $f_L$ because of the element 1014*a*, however, the VSWR characteristic is bad. In connection with the non-patent document 1, disc type monopole antennas are described in "B-131 IMPROVED INPUT IMPEDANCE OF CIRCULAR DISC MONOPOLE ANTENNA", Satoshi Honda, Yuken Ito, Hajime Seki and Yoshio Jinbo, 2-131, SPRING NATIONAL CONVENTION of The Institute of Electronics, Information and Communication Engineers, 1992, and "WIDEBAND MONOPOLE ANTENNA OF CIRCULAR DISC", Satoshi Honda, Yuken Ito, Yoshio Jinbo and Hajime Seiki, Vol. 15, No. 59, pp.25–30, 1991.10.24 in "TECHNICAL REPORTS OF THE INSTITUTE OF TELEVISION".

The antennas described above pertain to a monopole antenna in which a flat-plate conductor having various shapes is erected vertically to the ground surface, and a symmetric dipole antenna using two flat-plate conductors having the same shape.

Besides, U.S. Pat. No. 6,351,246 discloses a symmetric dipole antenna having a special shape as shown in FIG. 17. That is, a ground element 1103 is provided between conductive balance elements 1101 and 1102, and terminals 1104 and 1105, which are lowest portions of the balance element 1101 and 1102, are connected to the coaxial cables 1106 and 1107. Negative step voltage is supplied to the balance element 1101 via the coaxial cable 1106 and terminal 1104. On the other hand, positive step voltage is supplied to the balance element 1102 via the coaxial cable 1107 and terminal 1105. In this antenna 1100, though the distance between the ground element 1103 and the balance element 1101 or 1102 is gradually increased from the terminal 1104 or 1105 toward the outside, it is necessary to input different signals as described above to the balance elements 1101 and 1102, and in order to obtain desired characteristics, it is necessary to always use three elements, that is, the balance element 1101 and 1102 and the ground element 1103.

In addition, FIG. 18 shows a glass antenna device for an automobile telephone disclosed in JP-A-8-213820. In FIG. 18, a fan-shaped radiation pattern 1033 and a rectangular ground pattern 1034 are formed on a window glass 1032, a feed point A is connected to the core wire 1035*a* of a coaxial cable 1035, and a ground point B is connected to the outer conductor 1035*b* of the coaxial cable 1035. In this publication, the shape of the radiation pattern 1033 may be an isosceles triangular shape or a polygonal shape.

Furthermore, US-A-2002-122010A1 discloses an antenna 1020 in which a tapered clearance area 1023 and a driven element 1022 whose feed point 1025 is connected to a transmission line 1024 are provided within a ground element 1021 as shown in FIG. 19. Incidentally, the gap between the ground element 1021 and the driven element 1022 is maximum at the opposite side to the feed point 1025 on the driven element 1022, and the gap therebetween is minimum in the neighborhood of the feed point 1025. The driven element 1022 is equipped with a concavity at the opposite side to the feed point 1025 of the driven element 1022. The concavity itself is opposite to the ground element 1021, and it serves as means for adjusting the gap between the driven element 1022 and the ground element 1021.

As described above, though various antennas have been hitherto known, the conventional vertical mount type monopole antennas have problems that their sizes are large, and it is difficult to control the antenna characteristic since it is difficult to control the distance between the radiation conductor and the ground surface. Furthermore, the conventional symmetrical type dipole antennas also have a problem that it is difficult to control the antenna characteristic since the radiation conductors have the same shape, thereby it is difficult to control the distance between the radiation conductors.

Besides, the special symmetric dipole antenna described in U.S. Pat. No. 6,351,246 has a problem on the implementation, in which a lot of elements and two kinds of signals, which are supplied to the elements, must be prepared. In addition, the ground pattern 1103 is opposite to the balance element 1101 and 1102, but the sides of the ground element 1103, which are opposite to the balance element 1101 and 1102, are straight lines.

Furthermore, JP-A-8-213820 does not disclose and suggest that the outer shape of the ground pattern 1034 is processed.

In addition, though the antenna of US-A-2002-122010A1 aims at miniaturization, the structure that the driven element is provided within the ground element cannot achieve the sufficient miniaturization because of the shape of the ground element. Besides, the shape of the ground element does not have a tapered shape with respect to the driven element.

SUMMARY OF THE INVENTION

In view of the foregoing problems, an object of the present invention is to provide an antenna having a novel shape that can be miniaturized and widened in bandwidth, and a wireless communication card using that antenna.

Furthermore, another object of the present invention is to provide an antenna having a novel shape that can be miniaturized and make it easy to control the antenna characteristic, and a wireless communication card using that antenna.

An antenna according to a first aspect of the invention comprises a planar antenna element having a feed point; and a ground pattern being juxtaposed with the planar antenna element, and the ground pattern has a trimmed portion causing to continuously change a distance between the planar antenna element and the ground pattern.

By providing the trimmed portion, it is possible to appropriately adjust the coupling degree with the antenna element, thereby it is possible to widen the bandwidth. In addition, since the antenna element and the ground pattern are juxtaposed with each other, the miniaturization is achieved.

In addition, the trimmed portion may be formed from a point near the feed point toward a side being opposite to the planar antenna element. Moreover, the planar antenna element and the ground pattern may be formed extending along counter directions respectively. Furthermore, the ground element may be disposed without fully surrounding the planar antenna element.

Besides, the trimmed portion may be formed in a tapered shape with respect to the feed point of the planar antenna element. By providing the tapered shape for the ground pattern, it is possible to appropriately adjust the coupling degree with the antenna element, thereby it is possible to widen the bandwidth.

In addition, the tapered shape may be composed of any one of segments, curved lines being convex upwardly, and curved lines being convex downwardly. The tapered shape can be formed in accordance with the desired characteristic.

Furthermore, the tapered shape may be symmetric with respect to a straight line passing through the feed point of the antenna element. It is also possible to form a concavity accommodating a portion for feeding to the feed point of the antenna element at a tip of the tapered shape.

In addition, the antenna element may be formed on a dielectric substrate, the ground pattern may be formed in or on a resin board, and said dielectric substrate may be mounted on the resin board. When the antenna element is formed in or on the dielectric substrate, the size of the antenna can be further miniaturized. Incidentally, when the antenna element substrate is formed on the dielectric substrate, the coupling with the ground pattern becomes strong. However, by adopting the tapered shape, it is possible to appropriately adjust the coupling degree, thereby the wide bandwidth can be achieved.

Furthermore, the antenna element may have a cut-out portion formed from an edge portion farthest from the feed point toward the ground pattern. The cut-out portion may be formed at an edge portion being opposite to the ground pattern side of said antenna element. Even in a case where the antenna is miniaturized, by forming the cut-out portion, the length of the current path on the antenna element is sufficiently secured, thereby the bandwidth is widened in a low frequency side.

In addition, the antenna element may have a shape in which a bottom side thereof has a straight portion or a substantially straight portion adjacent to the ground pattern, lateral sides thereof are provided vertically or substantially vertically to the bottom side and the cut-out portion is provided in a top side thereof. Though there is a limit of the miniaturization of the antenna element in order to secure the characteristic of the low frequency range, the miniaturization and the wide bandwidth are enabled if the above-described structure of the antenna element is adopted. Incidentally, at that time, the tapered shape of the ground pattern enables to wholly enhance the impedance characteristics.

Furthermore, the dielectric substrate on which the antenna element is formed may be mounted at an upper end on the resin board.

In addition, the dielectric substrate on which the antenna element is formed may be mounted at an upper end on the resin board, and the ground pattern may be formed to have a region extending toward at least either of a right side and a left side of the dielectric substrate. By providing such a region, the bandwidth in the low frequency side can be widened.

Furthermore, the dielectric substrate on which the antenna element is formed may be mounted at at least either of a right upper end and a left upper end on the resin board, and the ground pattern may be formed to have a region extending toward an opposite side to a side in which the dielectric substrate is mounted.

An antenna according to a second aspect of this invention comprises: a dielectric substrate on which an antenna element is formed; and a board on which the dielectric substrate is mounted, and in or on which a ground pattern is formed to be juxtaposed with the dielectric substrate, and the ground pattern has a tapered shape with respect to a feed point of the antenna element, and the antenna element has a cut-out portion formed from an edge portion farthest from the feed point toward a side of the juxtaposed ground pattern.

In addition, the dielectric substrate may be mounted on an upper end on the board, and the ground pattern may be formed to provide a region extending toward at least either of the left and right of the dielectric substrate. Furthermore, a first dielectric substrate may be disposed on a right upper end on the board, a second dielectric substrate may be disposed on a left upper end on the board, and the ground pattern may have a region to separate the first and second dielectric substrate.

A wireless communication device according to a third aspect of this invention comprises: a dielectric substrate on which an antenna element is formed; a board on which the dielectric substrate is mounted, and in or on which a ground pattern juxtaposed with the dielectric substrate is formed; and a RF circuitry mounted on the ground pattern, and wherein the ground pattern has a trimmed portion causing to continuously change a distance between the planar antenna element and the ground pattern.

Incidentally, the ground pattern and the antenna element or dielectric substrate including the antenna element do not fully face each other, and both the planes thereof are parallel or substantially parallel to each other. Besides, the ground pattern and the antenna element or dielectric substrate including the antenna element do not completely overlap with each other, and both the planes thereof are parallel or substantially parallel to each other.

BRIEF DESCRIPTION OF THE DRAWINGS

FIG. 1A is a front view showing the structure of an antenna according to a first embodiment, and FIG. 1B is a side view of the antenna shown in FIG. 1A;

FIG. 2 is a diagram to explain the principle of the operation of the antenna according to a first embodiment;

FIGS. 16A-1, 16A-2, 16B-1, 16B-2, 16C, 16D, 16E, 16F, 16G, 16H, and 16I are diagrams showing the structures of conventional antennas;

DETAILED DESCRIPTION OF THE PREFERRED EMBODIMENTS

Preferred embodiments according to the present invention will be described with reference to the accompanying drawings.

1. First Embodiment

Figures 1, 16A:
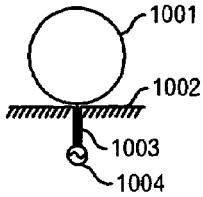

FIGS. 1A and 1B show the structure of an antenna according to a first embodiment of this invention. The antenna according to the first embodiment includes a dielectric substrate 7 that contains a conductive planar element 1 having a cut-out portion 5 therein and has a dielectric constant of about 20, a ground pattern 2 that is juxtaposed with the dielectric substrate 7 so as to make an interval of L1 (=1.0 mm) from the dielectric substrate 7 and in which a tapered shape is formed with respect to a feed point 1*a* of the planar element 1, a board 6, such as a printed circuit board (more specifically, a resin board made of FR-4, Teflon (registered trademark) or the like), and a high-frequency power source 3 connected to a feed point 1*a* of the planar element 1. The size of the dielectric substrate 7 is about 8 mm×10 mm×1 mm. In addition, the bottom side 1*b* of the planar element 1 is vertical to the line 4 passing through the feed point 1*a*, and the lateral sides 1*c* of the planar element 1 are parallel to the line 4. The corners of the bottom side 1*b* of the planar element 1 are splayed and equipped with sides 1*f*. The bottom side 1*b* are connected to the lateral sides 1*c* through the sides 1*f*. A rectangular cut-out portion 5 is provided for the top portion 1*d* of the planar element 1. The cut-out portion 5 is formed by concaving the top in a rectangular shape from the top portion 1*d* toward the ground pattern 2 side. The feed point 1*a* is provided at the intermediate point of the bottom side 1*b*.

In addition, the planar element 1 and the ground pattern 2 are designed to be symmetrical with respect to the line 4 passing through the feed point 1*a*. Accordingly, the cut-out portion 5 is also symmetrical with respect to the line 4. Furthermore, the length (hereinafter referred to as "distance") of a line segment extending from any point on the bottom side 1*b* of the planar element 1 to the ground pattern 2 in parallel with the line 4 is also symmetric with respect to the line 4.

FIG. 1B is a side view of the antenna shown in FIG. 1A, and the ground pattern 2 and the dielectric substrate 7 are provided on the board 6. The board 6 and the ground pattern 2 may be integrally formed with each other. Incidentally, in this embodiment, the planar element 1 is formed inside the dielectric substrate 7. That is, the dielectric substrate 7 is formed by laminating ceramic sheets, and the conductive planar element 1 is formed as one layer of the laminate. Accordingly, when the antenna is viewed from the upper side, it is not actually viewed like FIG. 1A. When the planar element 1 is formed in the dielectric substrate 7, the effect of the dielectric material is slightly stronger as compared with the case where the planar element is exposed, so that the antenna can be more miniaturized and reliability and/or resistance to such as rust or the like is enhanced. However, the planar element 1 may be formed on the surface of the dielectric substrate 7. Furthermore, the dielectric constant may be varied, and the dielectric substrate may be formed in a mono-layer or multi-layer structure. If it is formed in the mono-layer structure, the planar element 1 is formed on the board 6. Incidentally, in this embodiment, the plane of the dielectric material is arranged in parallel to or substantially in parallel to the plane of the ground pattern 2. This arrangement causes the plane of the planar element 1 contained in one layer of the dielectric substrate 7 to be disposed in parallel to or substantially in parallel to the plane of the ground pattern 2.

When the planar element 1 is formed to be covered by the dielectric substrate 7, the condition of the electromagnetic field around the planar element 1 is varied by the dielectric material. Specifically, since an effect of increasing the density of the electric field in the dielectric material and a wavelength shortening effect can be obtained, the planar element 1 can be miniaturized. Furthermore, the lift-off angle of the current path is varied by these effects, and an inductance component L and a capacitance component C in the impedance equivalent circuit of the antenna are varied. That is, the impedance characteristic is greatly affected. The shape of the planar element 1 is optimized so that a desired impedance characteristic can be achieved in a desired range in consideration for the effect on the aforementioned impedance characteristic.

In this embodiment, the upper edge portions 2*a* and 2*b* of the ground pattern 2 are downwardly inclined from the intersecting point with the line 4 by a height L2 (=2 to 3 mm) at the side edge portions of the grand pattern 2 in the case where the width of the grand pattern 2 is 20 mm. That is, the ground pattern 2 has a tapered shape formed of upper edge portions 2*a* and 2*b* with respect to the planar element 1. Since the bottom side 1*b* of the planar element 1 is vertical to the line 4, the distance between the bottom side 1*b* of the planar element 1 and the ground pattern 2 is linearly increased as approaching to the side edge portions. That is, the antenna according to this embodiment is equipped with a continuous varying portion at which the distance between the planar element 1 and the ground pattern 2 is continuously varied. By providing such a continuous varying portion, the coupling degree between the planar element 1 and the ground pattern 2 is adjusted. By adjusting the coupling degree, especially, the bandwidth at a high frequency side can be widened.

Figures 2, 16A:
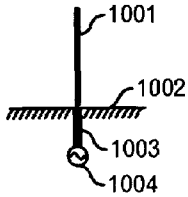
Figures 1, 16B:
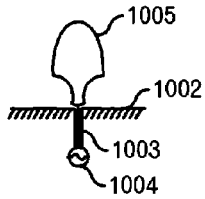
Figures 2, 16B:
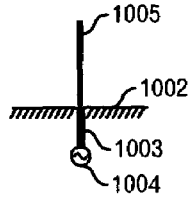
Figure 16C:
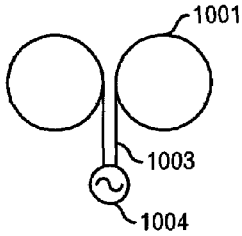
Figure 16D:
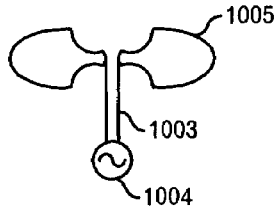
Figure 16E:
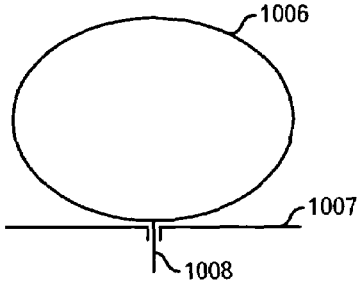
Figure 16F:
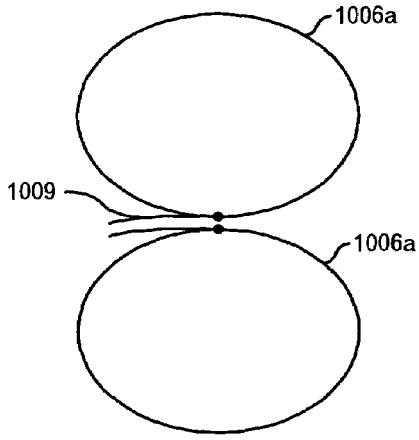
Figure 16G:
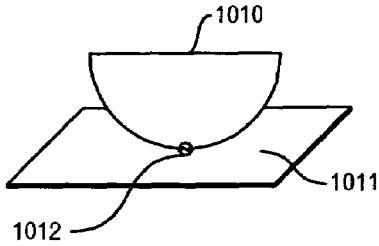
Figure 16H:
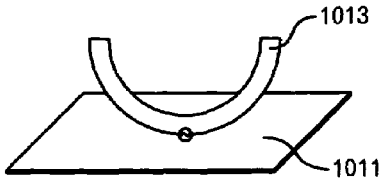
Figure 16I:
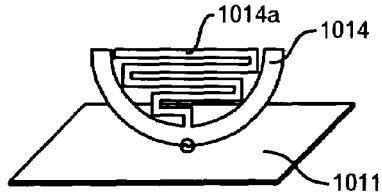
FIG.16I PRIOR ART
Figure 17:
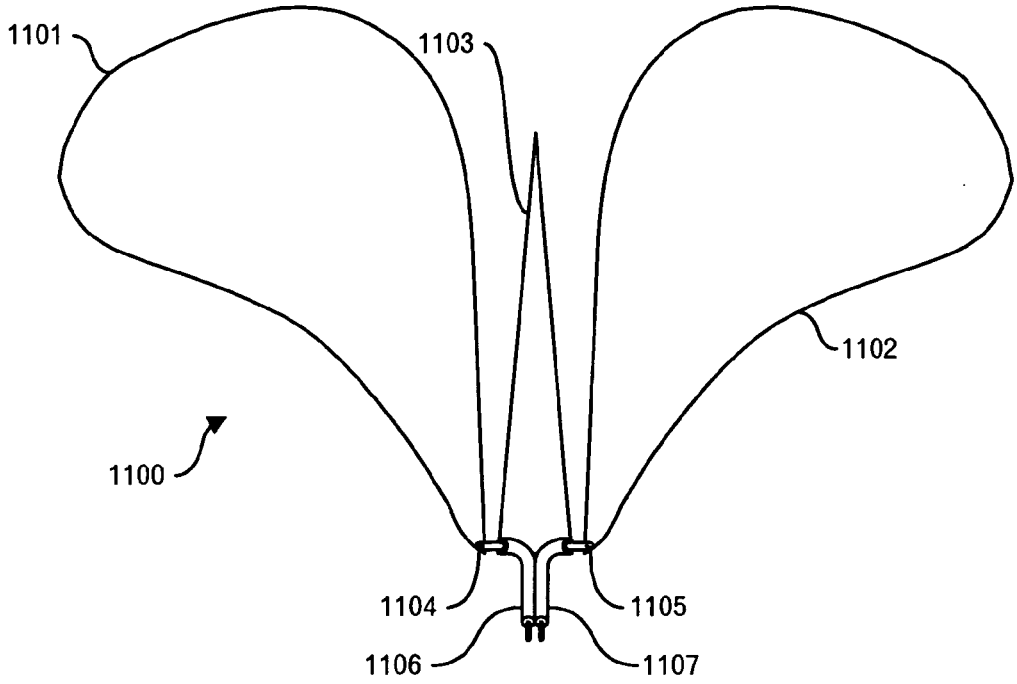
FIG.17 PRIOR ART
FIG. 17 is a diagram showing the structure of a conventional antenna.
Figure 18:
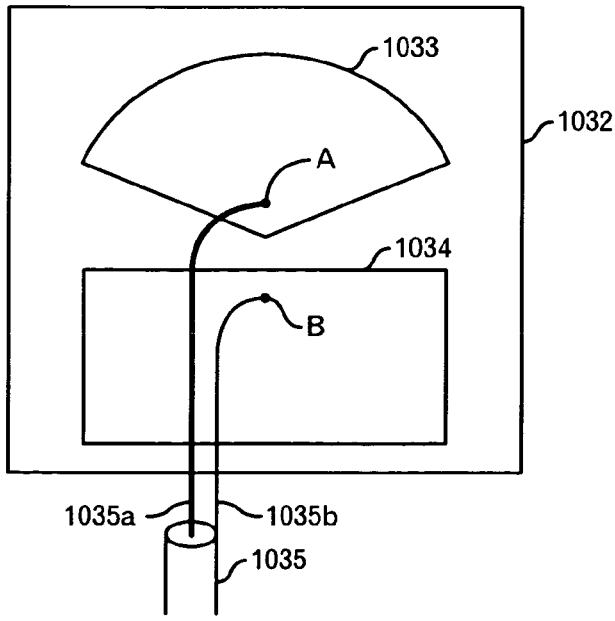
FIG.18 PRIOR ART
FIG. 18 is a diagram showing the structure of a conventional antenna.
Figure 19:
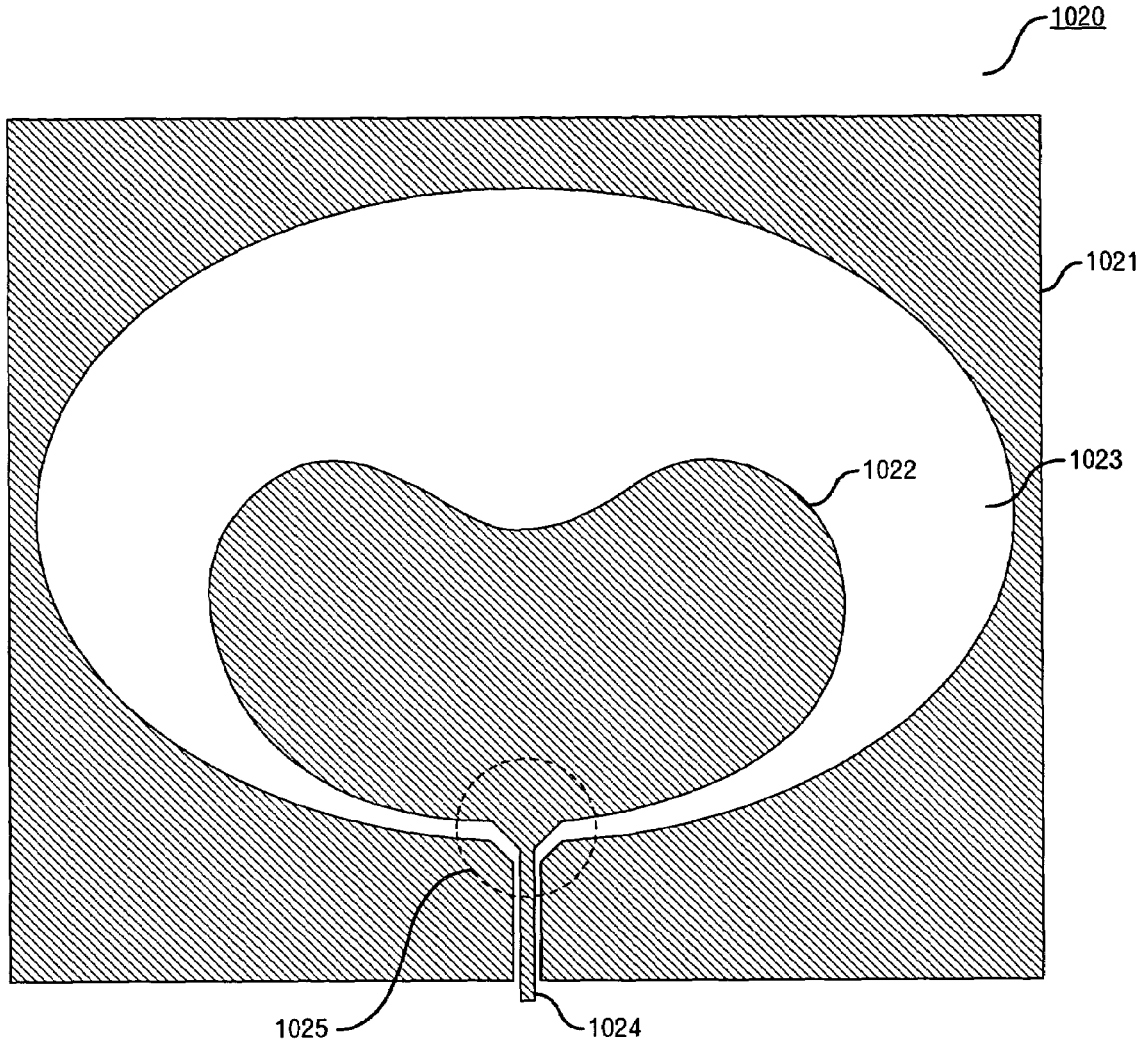
FIG.19 PRIOR ART
FIG. 19 is a diagram showing the structure of a conventional antenna.

The planar element 1 according to this embodiment is designed to have a shape with a rectangular cut-out portion 5 in order to further enhance miniaturization and secure current paths 8 for achieving a desired frequency bandwidth, as shown in FIG. 2. The antenna characteristic can be adjusted by the shape of the cut-out portion 5.

Incidentally, the planar element 1 of this embodiment may be considered as a radiation conductor of a monopole antenna like the prior arts. On the other hand, since the ground pattern 2 of the antenna of this embodiment partially contributes to radiation, the antenna of this embodiment is also considered as a dipole antenna. However, since the dipole antenna normally uses two radiation conductors having the same shape, the antenna of this embodiment may be called as an asymmetrical dipole antenna. Furthermore, the antenna of this embodiment is considered as a traveling wave antenna. Such considerations can be applied to all the embodiments described below.

2. Second Embodiment

Figure 3:
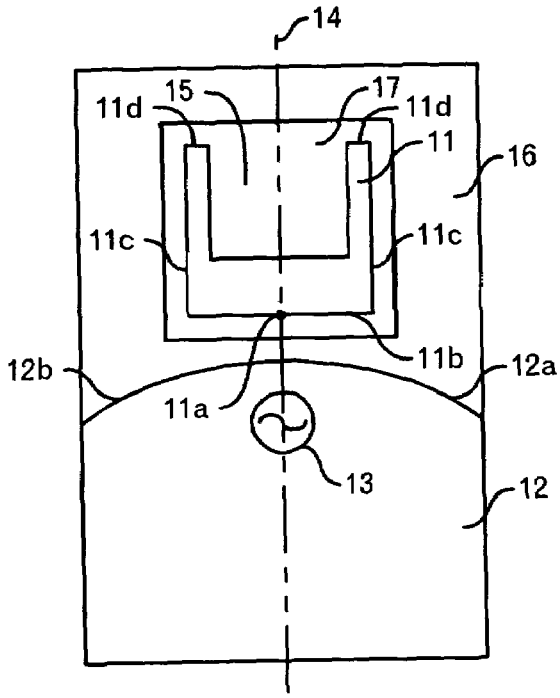
FIG. 3 is a diagram showing the structure of an antenna according to a second embodiment.

An antenna according to a second embodiment of the present invention comprises a dielectric substrate 17 that contains a planar element 11 therein and has a dielectric constant of about 20, a ground pattern 12 that is juxtaposed with the dielectric substrate 17 and has upper edge portions 12*a* and 12*b* that are upwardly convex curved lines, a board 16 such as a printed circuit board or the like, and a high-frequency power source 13 connected to a feed point 11*a* of the planar element 11 as shown in FIG. 3. The size of the dielectric substrate 17 is about 8 mm×10 mm×1 mm. In addition, the bottom side 11*b* of the planar element 11 is vertical to a line 14 passing through the feed point 11*a*, and lateral sides 11*c* connected to the bottom side 11*b* are parallel to the line 14. A cut-out portion 15 is provided at the top portion 11*d* of the planar element 11. The cut-out portion 15 is formed by concaving the top in a rectangular shape from the top portion 11*d* toward the ground pattern 12 side. The feed point 11*a* is provided at the intermediate point of the bottom side 11*b*. Incidentally, the difference between the planar element 1 of the dielectric substrate 7 according to the first embodiment and the planar element 11 of the dielectric substrate 17 in this embodiment exists in that the corners of the bottom side are splayed or not splayed.

The planar element 11 and the ground pattern 12 are designed symmetrically with respect to the line 14 passing through the feed point 11*a*. Furthermore, the length (hereinafter referred to as "distance") of a line segment extending from any point on the bottom side 11*b* of the plan element 11 to the ground pattern 12 in parallel to the line 14 is also symmetric with respect to the line 14.

Since the upper edge portion 12*a* and 12*b* of the ground pattern 12 is designed to be an upwardly convex curved line (for example, arc), the distance between the planar element 11 and the ground pattern 12 is gradually increased as approaching to the side edge portions of the ground pattern 12. In other words, though the angle is not an acute angle, a tapered shape with respect to the feed point 11*a* of the planar element 11 is made to the ground pattern. The structure of the side surface is almost the same as FIG. 1B.

A desired impedance characteristic can be achieved in a desired frequency range by adjusting the curvature of the curved line of the upper edge portions 12*a* and 12*b* of the ground pattern 12.

3. Third Embodiment

Figure 4:
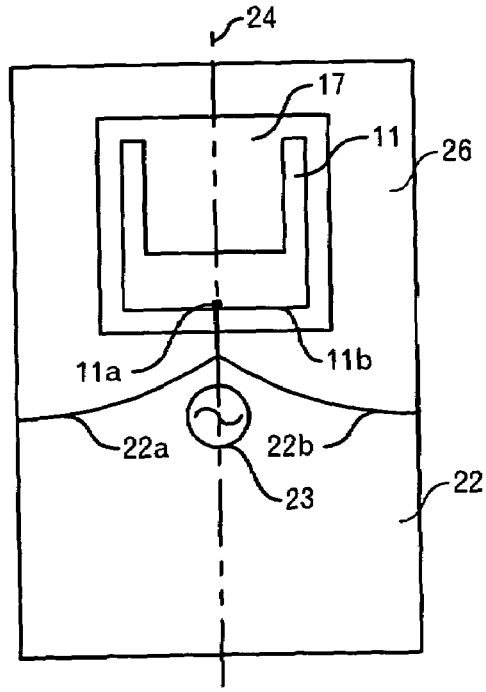
FIG. 4 is diagram showing the structure of an antenna according to a third embodiment.

As shown in FIG. 4, an antenna according to a third embodiment of the present invention comprises a dielectric substrate 17 containing a planar element 11 having the same shape as the second embodiment, a ground pattern 22 that is juxtaposed with the dielectric substrate 17 and has upper edge portions 22*a* and 22*b* which draw downward saturation curves, a board 26 such as a printed circuit board or the like on which the dielectric substrate 17 and the ground pattern 22 are mounted, and a high-frequency power source 23 connected to a feed point 11*a* of the planar element 11. The ground pattern 22 may be formed inside the board 26.

The planar element 11 and the ground pattern 12 are designed to be symmetric with respect to a line 24 passing through the feed point 11*a*. The length (hereinafter referred to as "distance") of a line segment extending from any point on the bottom side 11*b* of the planar element 11 to the ground pattern 22 in parallel to the line 24 is also symmetric with respect to the line 24.

Since the upper edge portions 22*a* and 22*b* of the ground pattern 22 are downward saturation curves starting from the cross-point between each saturated curve and the line 24, that is, downwardly convex curved lines, the distance between the planar element 11 and the ground pattern 22 asymptotically approaches a predetermined value as approaching to the side edge portions of the grand pattern 22. In other words, the tapered shape with respect to the dielectric substrate 17 is formed to the ground pattern 22.

A desired impedance characteristic can be achieved in a desired frequency range by adjusting the curvature of each of the curved lines of the upper edge portions 22*a* and 22*b* of the ground pattern 22.

4. Fourth Embodiment

Figure 5A:
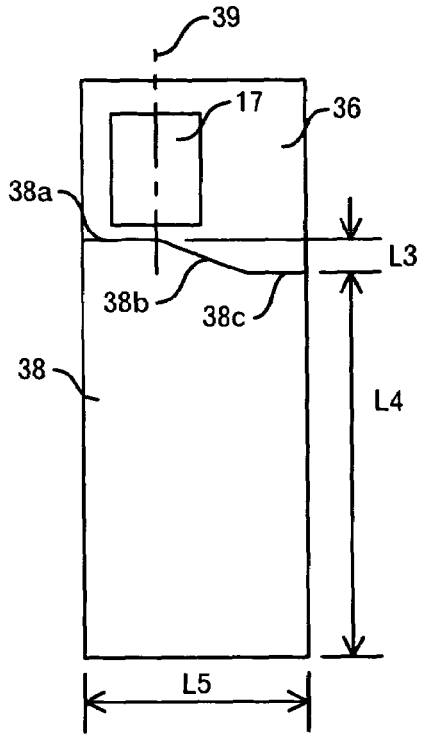
FIG. 5A is a diagram showing the structure of a first antenna according to a fourth embodiment.

Though there is no problem in a case where the ground pattern 12 can be formed to be symmetric with respect to the straight line 14 passing through the feed point 11*a* like the antenna according to the second embodiment of the present invention, there is a case where the ground pattern cannot be formed to be symmetric when the dielectric substrate 17 is mounted on the corner of the board 15, for example. Here, an optimum example is shown in a case where the ground pattern 12 cannot be formed to be symmetric as described above. As shown in FIG. 5A, when the dielectric substrate 16 must be disposed on the left corner of the board 36, the ground pattern 38 has such a shape that a side 38*a*, which is disposed at the left portion from a center line 39 of the dielectric substrate 17, is horizontal, a side 38*b*, which is disposed on the right portion, is declined, and a side 38*c* extending from a position, which falls down by L3 (=3 mm) from the side 38*a*, is horizontal. However, the ground pattern 38 has a tapered shape with respect to the dielectric substrate 17. Incidentally, the width L5 of the ground pattern 38 is 20 mm, and the length L4 of the right lateral side edge is 35 mm. Moreover, the size of the dielectric substrate 17 is the same as the second embodiment, that is, 8 mm×10 mm×1 mm.

By forming such the ground pattern 38, it becomes possible to obtain the impedance characteristic, which is almost similar to the structure having the symmetrical ground pattern.

Figure 5B:
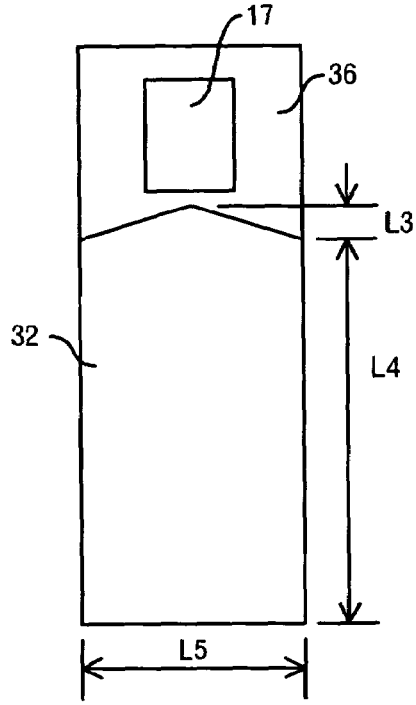
FIG. 5B is a diagram showing the structure of a second antenna according to the fourth element.

Incidentally, the antenna structure to be compared is shown in FIG. 5B. In an example of FIG. 5B, the dielectric substrate 17 is the same, the length of the lateral side edge is 35 mm (=L4), and the width is 20 mm (=L5). In addition, the upper edge portion of the ground pattern 32 is composed of two segments, which make the height from the highest point to the lateral side edge 3 mm (=L3) thereby the tapered shape is formed.

Figure 6:
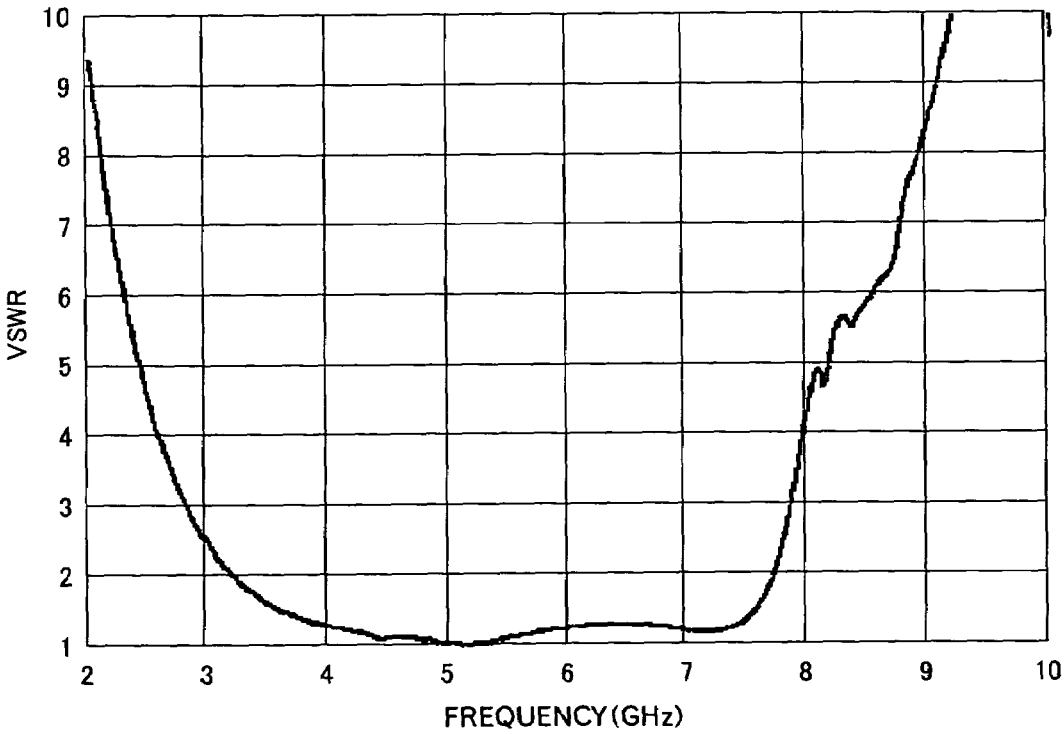
FIG. 6 is a diagram showing the impedance characteristic of the first antenna in the fourth embodiment.
Figure 7:
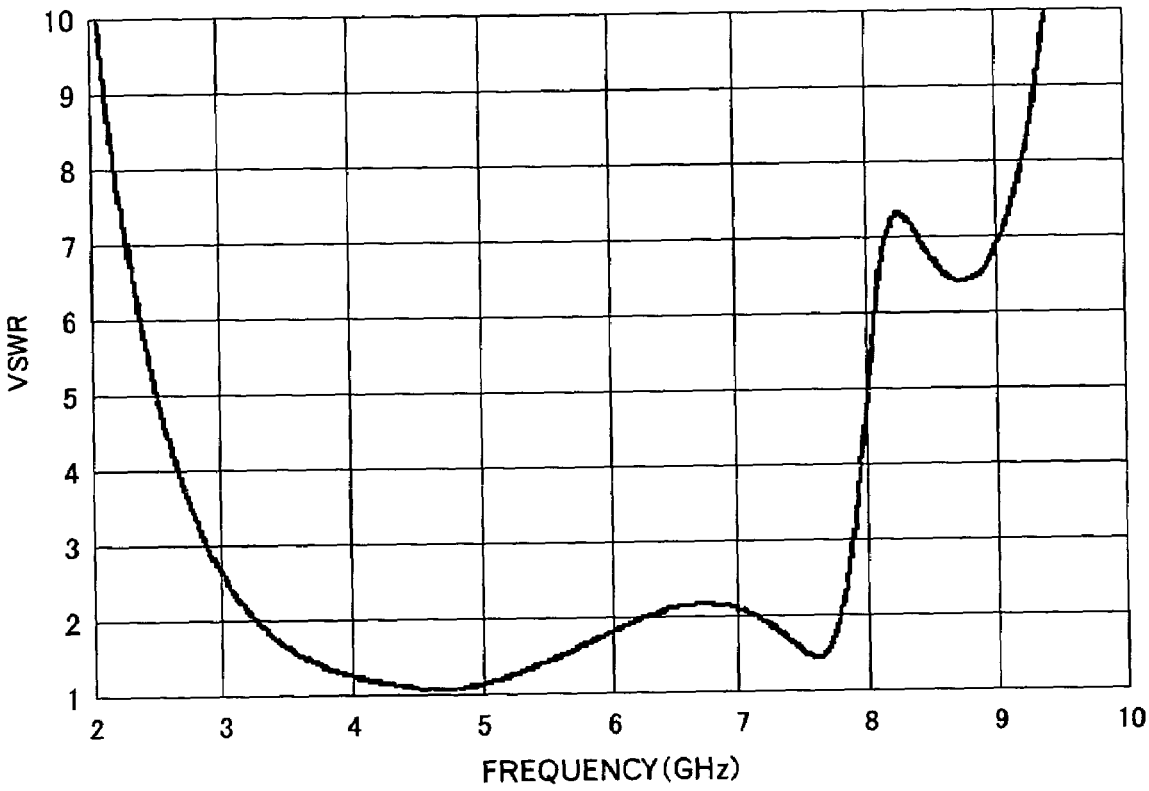
FIG. 7 is a diagram showing the impedance characteristic of the second antenna in the fourth embodiment.

The impedance characteristic of the antenna of FIG. 5A is shown in FIG. 6. In the graph of FIG. 6, the axis of ordinate represents VSWR, and the axis of abscissa represents the frequency (GHz). For example, the frequency range in which VSWR is not more than 2.5 approximately extends from about 3 GHz to about 7.8 GHz. Namely, the wide bandwidth is achieved. On the other hand, the impedance characteristic of the antenna of FIG. 5B is shown in FIG. 7. In the graph of FIG. 7, the axis of ordinate represents VSWR, and the axis of abscissa represents the frequency (GHz). For example, the frequency range in which VSWR is not more than 2.5 approximately extends from about 3.1 GHz to about 7.8 GHz. As shown in FIG. 6 and FIG. 7, the almost similar impedance characteristic can be obtained.

5. Fifth Embodiment

Figure 8:
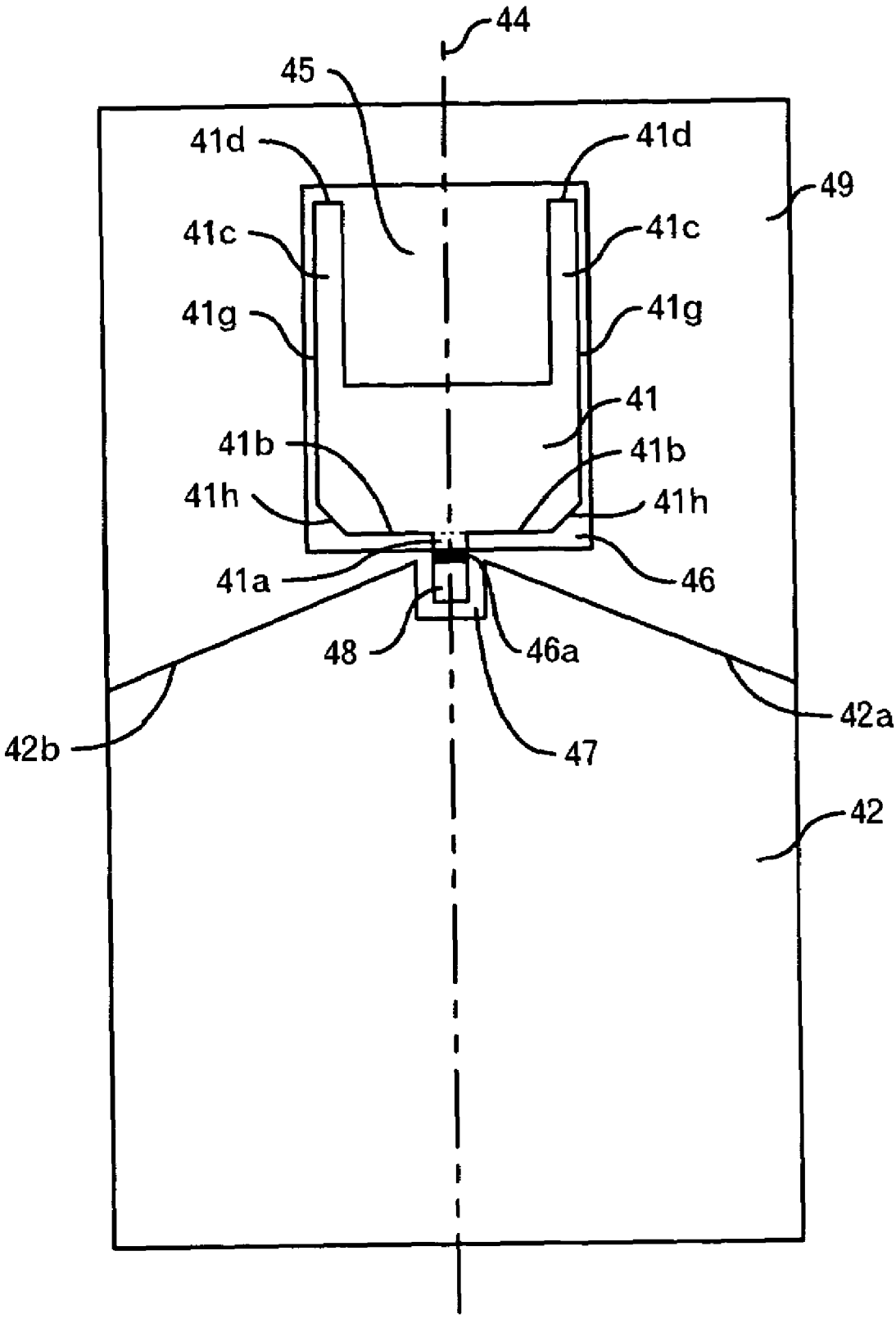
FIG. 8 is a diagram showing the structure of an antenna according to a fifth embodiment.

The structure of an antenna according to an fifth embodiment of the present invention is shown in FIG. 8. In this embodiment, an example will be explained in which a planar element 41 that is formed of a rectangular conductive flat plate and has a cut-out portion 45 is formed in a dielectric substrate 46 having a dielectric constant of about 20. The antenna according to this embodiment comprises the dielectric substrate 46 that contains the planar element 41 therein and has an external electrode 46*a* at the outside thereof, a feed portion 48 that is connected to a high-frequency power source (not shown) to supply power to the planar element 41 and connected to the external electrode 46*a* of the dielectric substrate 46, and a ground pattern 42 that has a recess 47 for accommodating the feed portion 48 and has a tapered shape with respect to the feed position of the planar element 41. Incidentally, the dielectric substrate 46 is mounted on a board 49 such as a printed circuit board, and the ground pattern 42 is formed in the board 49 or on the surface of the board 49.

The external electrode 46*a* is connected to a projecting portion 41*a* of the planar element 41, and extends to the back surface (i.e. dotted line portion of the back surface) of the dielectric substrate 46. The feed portion 48 contacts with the external electrode 46*a* that is provided on the end portion of the side surface and the back surface of the dielectric substrate 46, and the feed portion 48 and the external electrode 46*a* are overlapped in the dotted line portion.

The planar element 41 is equipped with a projecting portion 41*a* connected to the external electrode 46*a*, a side 41*b* opposite to sides 42*a* and 42*b* of the ground pattern 42, arm portions 41*c* for securing current paths for low frequencies, and a rectangular cut-out portion 45 formed so as to concave from the top portion 41*d* toward the ground pattern 42. Moreover, the side 41*b* and the lateral side portions 41*g* are connected to each other through sides 41*h* formed by splaying the side 41*b*. Incidentally, the dielectric substrate 46 containing the planar element 41 is juxtaposed with the ground pattern 42.

Incidentally, in this embodiment, the planar element 41 is formed inside the dielectric substrate 46. That is, the dielectric substrate 46 is formed by laminating ceramic sheets, and the conductive planar element 41 is formed as one layer of the laminate. Accordingly, when viewed from the upper side, the planar element 1101 is not actually viewed like FIG. 8. However, the planar element 41 may be formed on the surface of the dielectric substrate 46.

Since the recess 47 for accommodating the feed portion 48 is provided to the tip having the tapered shape and composed of the sides 42*a* and 42*b* in the ground pattern 42, the edge portion of the ground pattern 42 opposite to the side 41*b* of the planar element 41 is not straight, and are divided into two sides 42*a* and 42*b*. Incidentally, the antenna according to this embodiment is symmetric with respect to a line 44 passing through the center of the feed portion 48, which is the feed position. The rectangular cut-out portion 45 and the tapered shape of the ground pattern 42 are also symmetrical with respect to the line 44. The sides 42*a* and 42*b* are inclined so that the distance between the side 41*b* of the planar element 41 and the sides 42*a* or 42*b* of the ground pattern 42 is linearly increased as being farther away from the line 44. Incidentally, the structure of the side surface is almost the same as FIG. 1B except for the portions corresponding to the feed portion 48 and the external electrode 46*a*.

Figure 9:
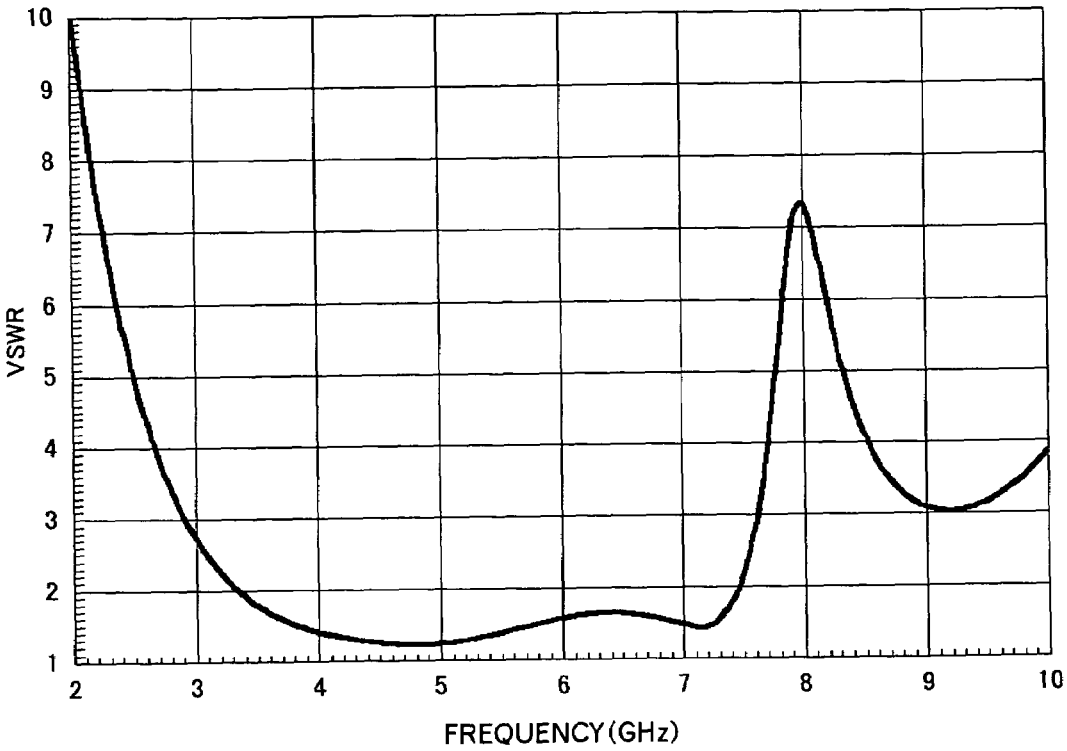
FIG. 9 is a diagram showing the impedance characteristic of the antenna according to the fifth embodiment.

FIG. 9 shows the impedance characteristic of the antenna according to this embodiment. In FIG. 9, the axis of ordinate represents VSWR, and the axis of abscissa represents the frequency (GHz). The frequency range in which VSWR is not more than 2.5 extends from about 3.1 GHz to about 7.6 GHz.

6. Sixth Embodiment

From a sixth embodiment to a ninth embodiment, optimization examples of the ground shape and application examples to the wireless communication card will be shown. Basically, the dielectric substrate 46 and planar element 41, and the shape of the ground pattern 42, which were shown in the fifth embodiment (FIG. 8), are used. By adopting such elements, an ultra wide bandwidth antenna, whose frequency range extends from about 3 GHz to 12 GHz, can be achieved. Especially, since the tapered shape with respect to the feed point 41*a* of the planar element 41 is formed of the optimized ground shape to the ground pattern 42, it is possible to appropriately adjust the coupling degree between the planar element 41 and the ground pattern 42, thereby a desired impedance characteristic can be obtained. Incidentally, the sides 41*h*, which are provided at the bottom side of the planar element 41 shown in FIG. 8, are not necessarily provided.

Figure 10:
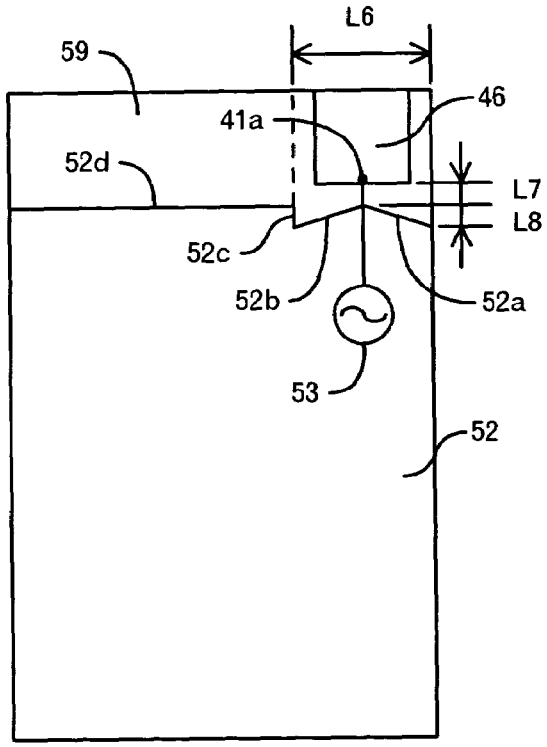
FIG. 10 is a diagram showing the structure of an antenna according to a sixth embodiment.

In this embodiment, FIG. 10 shows an example in which this invention is applied to a wireless communication card, such as a PC card, compact flash (CF, registered trade mark) card or the like, which is used by inserting a slot of a personal computer, personal digital assistant (PDA), or the like. FIG. 10 shows a dielectric substrate 46 that is the same as the dielectric substrate according to the fifth embodiment, a high frequency power source 53 connected to the feed point 41*a*, and a printed circuit board 59 having the ground pattern 52. The dielectric substrate 46 is disposed on a right or left upper end portion of the printed circuit board 59 and away from the ground pattern 52 by L1 (=1 mm). The tapered shape with respect to the feed point 41*a* is formed by sides 52*a* and 52*b* facing the dielectric substrate 46. Though the difference L8 of the height between a point of the ground pattern 52, which is nearest to the feed point 41*a*, and an intersecting point of the right lateral edge portion of the printed circuit board 59 and the side 52*a* is 2 to 3 mm, the characteristics in a case where the difference L8 of the height is changed will be explained later when comparing the impedance characteristics. The tapered shape is symmetric with respect to the straight line passing through the feed point 41*a*, but the side 52*b* is connected with a vertical side 52*c* of the length L8, and the side 52*c* is connected with a horizontal side 52*d*. In FIG. 10, the side 52*d* is horizontal, and the region of the dielectric substrate 46 and the region of the ground pattern 52 are separated up and down. Incidentally, the length L6 is 10 mm.

7. Seventh Embodiment

Figure 11:
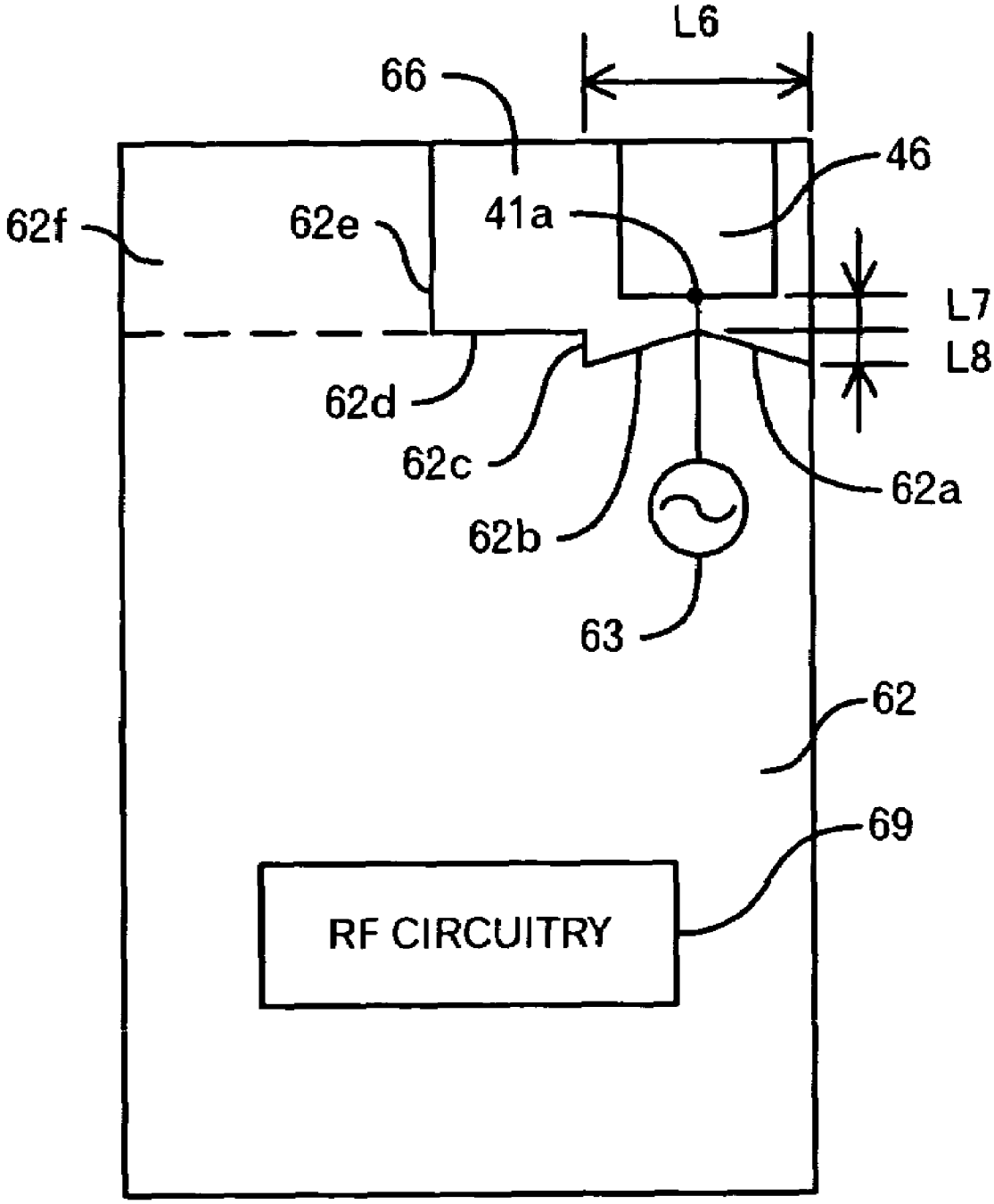
FIG. 11 is a diagram showing the structure of an antenna according to a seventh embodiment.

FIG. 11 shows a printed circuit board 66 of a wireless communication card according to this embodiment. The printed circuit board 66 of the wireless communication card according to this embodiment comprises the dielectric substrate 46, which is the same as the dielectric substrate according to the fifth embodiment, a high frequency power source 63 connected with the feed point 41*a*, and a ground pattern 62. A RF (Radio Frequency) circuitry 69 is mounted on the ground pattern 61. The dielectric substrate 46 is disposed on the right upper end portion of the printed circuit board 66 and apart from the ground pattern 62 by L7 (=1 mm). The tapered shape with respect to the feed point 41*a* of the planar element 4 is formed by the sides 62*a* and 62*b* opposite to the dielectric substrate 46. The shortest distance between the ground pattern 62 and the dielectric substrate 46 is L7. The difference L8 of the height between a point of the ground pattern 62, which is nearest to the feed point 41*a*, and an intersecting point of the right lateral side portion of the printed circuit board 55 and the side 62*a* is 2 to 3 mm. Though the tapered shape composed of the sides 62*a* and 62*b* is symmetric with respect to the straight line passing through the feed point 41*a*, the side 62*b* is connected with a vertical side 62*c* of the length L8, and the side 62*c* is connected with a horizontal side 62*d*. In this embodiment, the side 62*d* is further connected with a vertical side 62*e*. Thus, the ground pattern 62 is formed so as to partially surround the dielectric substrate 46 by the sides 62*e*, 62*d*, 62*c*, 62*b* and 62*a*. That is, the ground pattern 62 is formed so as not to fully surround the planar element 41 and so as to provide an opening for at least a part, which includes the cut-out portion 45, of the edge portion of the planar element 41. In this embodiment, since the ground pattern 62 opposite to the top portion including the cut-out portion and the right side edge portion of the planar element 41 is not provided, it can be said that there is an opening if a cover for the printed circuit board 66 is not considered. Incidentally, L6 is 10 mm. In addition, though FIG. 11 shows an example in which the dielectric substrate 45 is disposed on the right upper edge, the dielectric substrate 46 may be disposed on the left upper edge. At that time, an area of the ground pattern 62 extends to the right side of the dielectric substrate 46.

Figure 12:
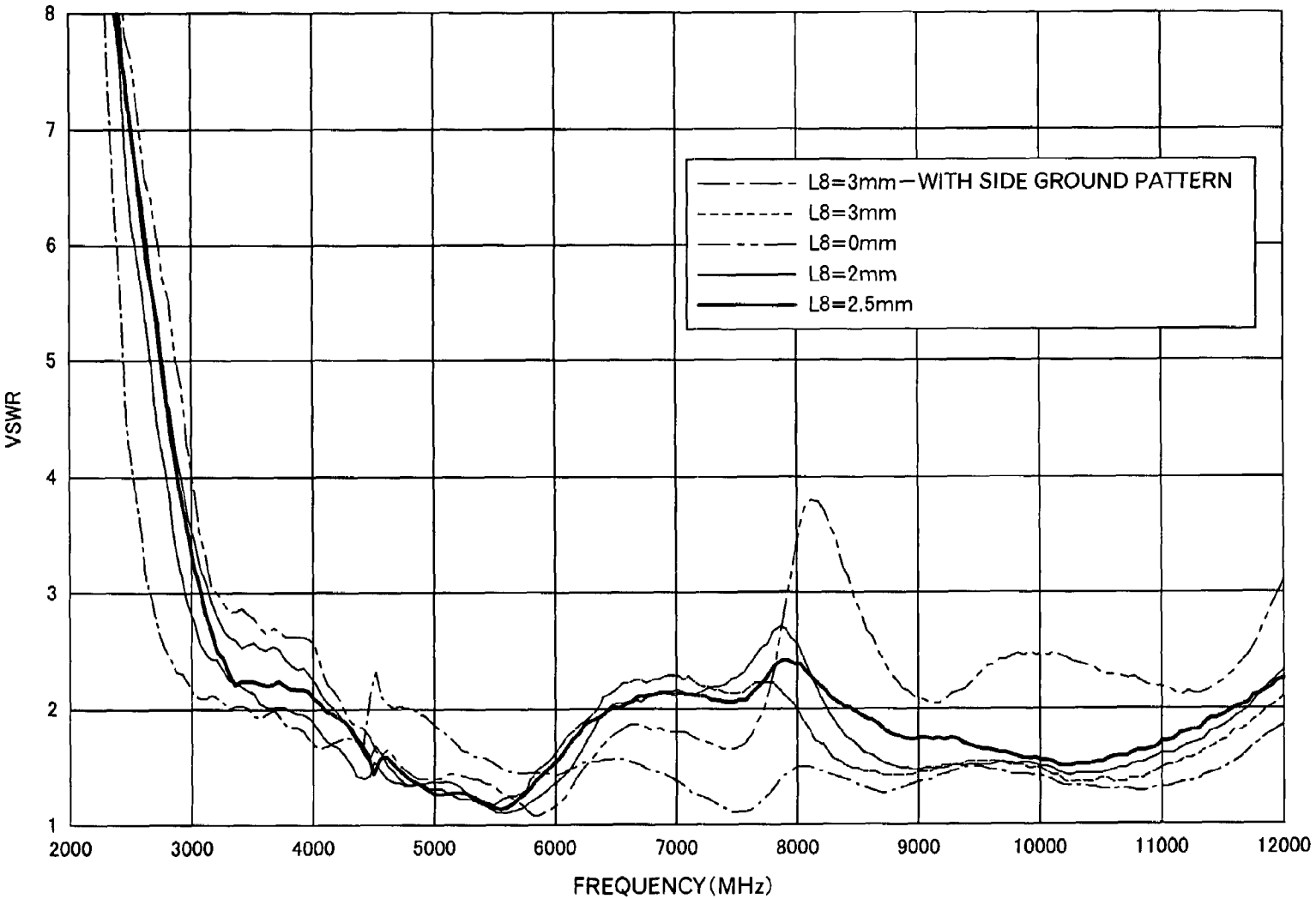
FIG. 12 is a diagram showing the impedance characteristics according to the sixth embodiment and the seventh embodiment.

FIG. 12 shows a drawing to compare differences in the impedance characteristic, which are based on the length of L8 and existence or absence of a ground region 62*f* that is disposed on the left of the dielectric substrate 46. In FIG. 12, the axis of ordinate represents VSWR, and the axis of abscissa represents the frequency (MHz). The one dotted dash rule represents the characteristic in a case where L8 is set to 3 mm and the ground region 62*f* is provided, the dotted line represents the characteristic in a case where L8 is set to 3 mm, the two dotted dash rule represents the characteristic in a case where L8 is set to 0, the solid line represents the characteristic in a case where L8 is set to 2 mm, and the thick line represents the characteristic in a case where L8 is set to 2.5 mm. The two dotted dash rule representing the characteristic of L8=0 indicates that the characteristic at frequencies more than about 7700 MHz is bad. In addition, the solid line representing the characteristic of L8=2 mm has a relatively large peak at a frequency of about 7800 MHz. The thick line representing the characteristic of L8=2.5 mm has a lower peak than the solid line at a frequency of about 7900 MHz. As for the dotted line representing the characteristic of L8=3 mm, though the value of the VSWR is more than 2 at frequencies of about 6400 MHz to about 8000 MHz, the peak is low, and the characteristic more than about 8000 MHz is good until the value of the VSWR exceeds 2 again at frequencies near about 12000 MHz. In addition, in the low frequency range, the value of the VSWR is lower than that of L8=2.5 mm or shorter. As for the one dotted dash rule representing the characteristic in the case where the L8=3 mm and the ground region 62*f* is added, except that a low peak occurs at a frequency of about 4500 MHz, the value of VSWR is kept not more than 2 at frequencies of about 3500 MHz or more. If the threshold value of VSWR is set to about 2.4, an ultra wide bandwidth from about 3000 MHz to 12000 MHz is achieved. Thus, by adding the ground region 62*f* on the left of the dielectric substrate 46, the effect to improve the value of VSWR from about 6000 MHz to about 9000 MHz and in the low frequency range from about 3000 MHz to about 4000 MHz can be obtained.

8. Eighth Embodiment

Figure 13:
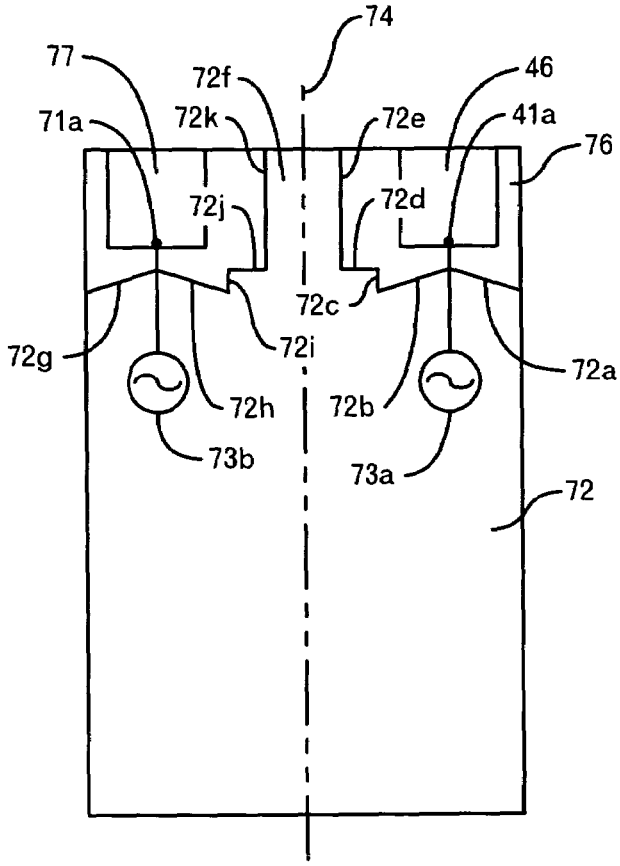
FIG. 13 is a diagram showing the structure of a space diversity antenna according to an eighth embodiment.

In this embodiment, an example is explained in which the seventh embodiment is applied to a diversity antenna. Normally, the space diversity antenna is used by switching two antennas, which are disposed apart from each other by a quarter wavelength. Accordingly, as shown in FIG. 13, two dielectric substrates are disposed on the right and left upper end of the printed circuit board 76.

A first antenna includes a dielectric substrate 46, which is the same as the dielectric substrate in the fifth embodiment, a high frequency power source 73*a* connected with the feed point 41*a*, and a ground pattern 72. The dielectric substrate 46 is provided on the right upper end of the printed circuit board 76 and vertically apart from the ground pattern 72 by 1 mm. By the sides 72*a* and 72*b* of the ground pattern 72, the tapered shape is formed with respect to the feed point 41*a* of the planar element 41. The difference of the height between a point of the ground pattern 72, which is nearest to the feed point 41*a*, and an intersecting point of the right lateral edge portion of the printed circuit board 76 and the side 72*a* is 2 to 3 mm. Though the tapered shape formed by the sides 72*a* and 72*b* is symmetric with respect to the straight line passing through the feed point 41*a*, the side 72*b* is connected to a vertical side 72*c*, and the side 72*c* is connected to a horizontal side 72*d*. The side 72*d* is further connected to a vertical side 72*e*. That is, a region 72*f* opposite to the left side surface of the dielectric substrate 46 and provided to separate the dielectric substrate 46 from a second antenna is added to the ground pattern 72. Thus, the ground pattern 72 has a shape partially surrounding the dielectric substrate 46 by the sides 72*e*, 72*d*, 72*c*, 72*b* and 72*a*. That is, the ground pattern is formed so as not to fully surround all the edge portions of the planar element 41 and so as to provide an opening to at least a part, which includes the cut-out portion, of the edge portion of the planar element 41. In this embodiment, since the ground pattern 72 opposite to the top portion including the cut-out portion and the right side edge portion of the planar element 41 is not provided, it can be said that there is an opening if a cover for the printed circuit board 76 is not considered.

A second antenna includes a dielectric substrate 77, which is the same as the dielectric substrate 46, a high frequency power source 73*b* connected with the feed point 71*a*, and a ground pattern 72. The dielectric substrate 77 is provided on the left upper end of the printed circuit board 76 and vertically apart from the ground pattern 72 by 1 mm. By the sides 72*g* and 72*h* of the ground pattern 72, the tapered shape is formed with respect to the feed point 71*a* of the planar element. The difference of the height between a point of the ground pattern 72, which is nearest to the feed point 71*a*, and an intersecting point of the left lateral edge portion of the printed circuit board 76 and the side 72*g* is 2 to 3 mm. Though the tapered shape formed by the sides 72*g* and 72*h* is symmetric with respect to the straight line passing through the feed point 71*a*, the side 72*h* is connected to a vertical side 72*i*, and the side 72*i* is connected to a horizontal side 72*j*. The side 72*j* is further connected to a vertical side 72*k*. That is, the region 72*f* opposite to the right side surface of the dielectric substrate 77 and provided to separate the dielectric substrate 77 from the first antenna is added to the ground pattern 72. Thus, the ground pattern 72 has a shape partially surrounding the dielectric substrate 77 by the sides 72*g*, 72*h*, 72*i*, 72*j* and 72*k*. That is, the ground pattern 72 is formed so as not to fully surround all the edge portions of the planar element and so as to provide an opening to at least a part, which includes the cut-out portion, of the edge portion of the planar element. In this embodiment, since the ground pattern 72 opposite to the top portion including the cut-out portion and the left side edge portion of the planar element is not provided, it can be said that there is an opening if a cover for the printed circuit board 76 is not considered. Basically, the printed circuit board 76 of this wireless communication card is symmetric with respect to the straight line 75.

Thus, the space diversity antenna can be implemented in the wireless communication antenna.

9. Ninth Embodiment

Figure 14:
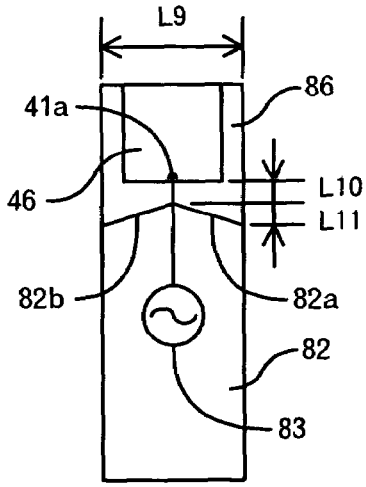
FIG. 14 is a diagram showing the shape of an antenna in a stick-type wireless communication card according to a ninth embodiment.

FIG. 14 shows an embodiment in which the antenna according to the fifth embodiment is applied to a stick type wireless communication card. A printed circuit board 86 according to this embodiment has the dielectric substrate 46 that is the same as that in the fifth embodiment, a high frequency power source 83 connected to the feed point 41*a*, and a ground pattern 82. The dielectric substrate 46 is mounted on the upper end of the printed circuit board 86 and disposed away from the ground pattern 86 by L10 (=1 mm). The ground pattern 82 is formed to have a tapered shape with respect to the feed point 41*a* of the planar element 46 by sides 82*a* and 82*b*. The difference L11 of the height between a point of the ground pattern 82, which is nearest to the feed point 41*a*, and an intersecting point of the lateral side edge of the printed circuit board 86 and the side 82*a* or 82*b* is 2 to 3 mm. In addition, the ground pattern 82 having the tapered shape is symmetric with respect to the straight line passing the feed point 41*a*. Incidentally, L9 is 10 mm.

Thus, if the dielectric substrate 46 is used, it is possible to implement it inside the small stick type wireless communication card.

10. Tenth Embodiment

Though examples in which the planar element is integrally formed into the dielectric substrate were explained in the above-described embodiments, the planar element is not necessarily formed into the dielectric substrate. Next, an example of an antenna that does not use the dielectric substrate is explained.

Figure 15A:
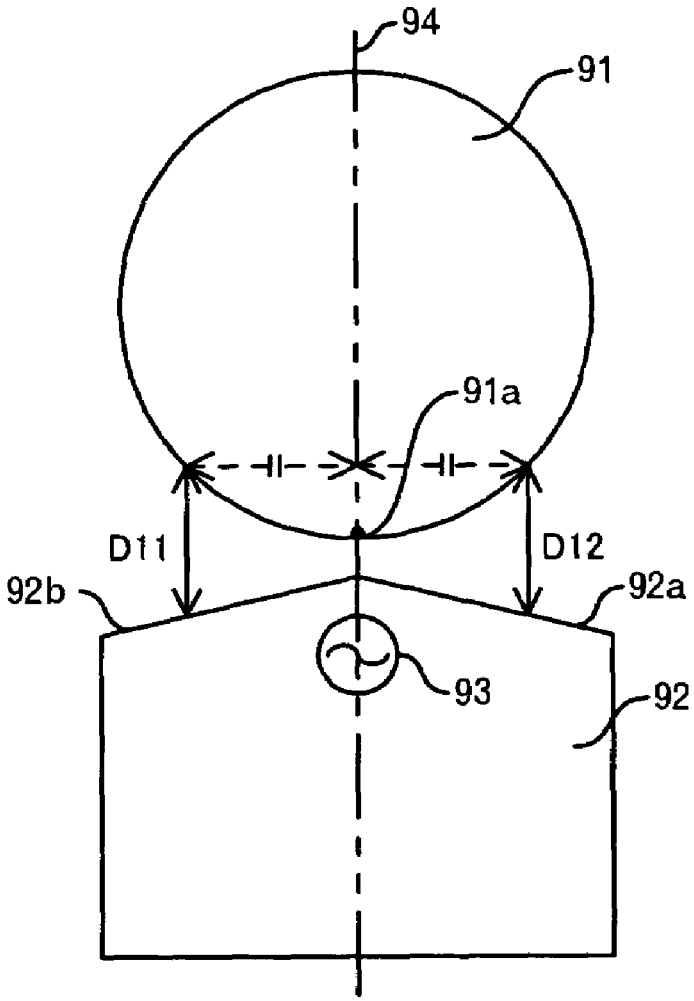
FIG. 15A is a front view showing the structure of an antenna according to a tenth embodiment.
Figure 15B:
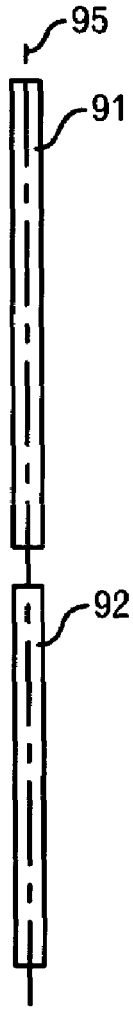
FIG. 15B is a side view of the antenna shown in FIG. 15A.

The structure of an antenna according to a tenth embodiment of the present invention is shown in FIGS. 15A and 15B. This antenna is composed of a circular conductive planar element 91, a ground pattern 92 juxtaposed with the planar element 91, and a high frequency power source 93 connected to a feed point 91*a* of the planar element 91. The feed point 91*a* is located at such a position that the distance between the planar element 91 and the ground pattern 92 is shortest.

Besides, the planar element 91 and the ground pattern 92 are symmetrical with respect to a straight line 94 passing through the feed point 91*a*. Furthermore, the length (hereinafter referred to as "distance") of a line segment extending from any point on the arc of the planar element 91 to the ground pattern 92 in parallel with the line 94 is also symmetric with respect to the line 94. That is, if the distances from the straight line 94 are the same, the distances D11 and D12 extending from any point of the arc of the planar element 91 to the ground pattern are the same.

In this embodiment, sides 92*a* and 92*b* of the ground pattern 92, which are opposite to the planar element 91, are declined so that the distance between the planar element 91 and the ground pattern 92 becomes longer as being farther away from the straight line 94. That is, the ground pattern 92 is formed to have a tapered shape with respect to the feed point 91*a* of the planar element 91. Incidentally, the inclination of the sides 92*a* and 92*b* must be adjusted to obtain a desired antenna characteristic. As compared with a case using the dielectric substrate, since the coupling degree with the ground pattern 92 is low, too much inclination causes aggravation of the characteristic in the low frequency range.

Thus, by changing the distance between the planar element 91 and the ground pattern 92, the capacitance component C in the impedance equivalent circuit of the antenna is changed. As shown in FIG. 15A, since the distance between the planar element 91 and the ground pattern 92 becomes longer as moving toward the lateral side edge, the capacitance component C also becomes smaller as moving toward the lateral side edge. Accordingly, the inductance component L in the impedance equivalent circuit becomes relatively more effective.

Furthermore, according to this embodiment, the planar element 91 is disposed on the center line 95 of the ground pattern 92 as shown in FIG. 15B. Accordingly, in this embodiment, the planar element 91 and the ground pattern 92 are located on the same plane. However, they are not necessarily located on the same plane, and they may be disposed so that the planes thereof are parallel or substantially parallel to each other.

Furthermore, the shape of the planar element 91 is not limited to the circle, and a reverse triangle and a semicircle, in which the arc is opposite to the ground pattern and a rectangular cut-out portion is formed from the top diameter portion toward the ground pattern may be adopted. The semicircle is not limited to a shape formed by dividing a complete circle into two portions, but a shape formed by dividing an ellipse into two portions may be adopted. At that time, if the tapered shape with respect to the feed position of the planar element 91 is formed to the ground pattern, it is possible to adjust the impedance characteristic according to the shape.

Though the embodiments of the present invention were explained, this invention is not limited to these embodiments. For example, though the shape of the cut-out portion of the planar element is indicated to be a rectangle as a typical example, it may be designed in a trapezoidal shape or other polygonal shape. The corners of the cut-out portion may be rounded. As for the tapered shape of the ground pattern, though an example in which a recess for accommodating an electrode for feeding is provided was explained, it is not necessary to form an acute angle to the tip of the ground pattern. Moreover, the planar element and the ground pattern do not completely overlap with each other but may partially overlap.

Although the present invention has been described with respect to a specific preferred embodiment thereof, various change and modifications may be suggested to one skilled in the art, and it is intended that the present invention encompass such changes and modifications as fall within the scope of the appended claims.

What is claimed is:

1. An antenna, comprising:

a planar antenna element that is conductive and includes a feed point; and a planar ground pattern, wherein said planar ground pattern and said planar antenna element do not cover each other, said planar antenna element and said planar ground pattern both contribute to radiation and are asymmetric with respect to each other, said planar ground pattern has a trimmed portion causing to continuously change a distance between said planar antenna element and said planar ground pattern, and said planar antenna element has a shape in which a bottom side thereof has a straight portion or a substantially straight portion adjacent to said planar ground pattern.

2. The antenna as set forth in claim 1, wherein said trimmed portion is formed from a point near said feed point toward a side being opposite to said planar antenna element.

3. The antenna as set forth in claim 1, wherein said planar antenna element and said planar ground pattern are formed extending along counter directions respectively.

4. The antenna as set forth in claim 1, wherein said planar ground element is disposed without fully surrounding said planar antenna element.

5. The antenna as set forth in claim 1, wherein said trimmed portion is formed in a tapered shape with respect to said feed point of said planar antenna element.

6. The antenna as set forth in claim 5, wherein said tapered shape is composed of any one of segments, curved lines being convex upwardly, and curved lines being convex downwardly.

7. The antenna as set forth in claim 5, wherein said tapered shape is symmetric with respect to a straight line passing through said feed point of said planar antenna element.

8. The antenna as set forth in claim 5, wherein a concavity accommodating a portion for feeding to said feed point of said planar antenna element is formed at a tip of said tapered shape.

9. The antenna as set forth in claim 1, wherein said planar antenna element is formed on a dielectric substrate, said planar ground pattern is formed in or on a resin board, and said dielectric substrate is mounted on said resin board.

10. The antenna as set forth in claim 9, wherein said dielectric substrate on which said planar antenna element is formed is mounted at an upper end of said resin board, and said planar ground pattern is formed to have a region extending toward at least either of a right side and a left side of the dielectric substrate.

11. The antenna as set forth in claim 9, wherein said dielectric substrate on which said planar antenna element is formed is mounted at at least either of a right upper end and a left upper end of said resin board, and said planar ground pattern is formed to have a region extending toward an opposite side to a side at which said dielectric substrate is mounted.

12. The antenna as set forth in claim 1, wherein said planar antenna element has a shape in which lateral sides thereof are provided vertically or substantially vertically to said bottom side, and a cut-out portion is provided in a top side thereof.

13. The antenna as set fourth in claim 1, wherein both planes of said planar ground pattern and said antenna element are parallel or substantially parallel to each other.

14. An antenna, comprising:

a dielectric substrate on which an antenna element that is conductive is formed; and a board on which said dielectric substrate is mounted, and in or on which a planar ground pattern is formed, wherein said planar ground pattern and said antenna element do not cover each other, said planar antenna element and said planar ground pattern both contribute to radiation and are asymmetric with respect to each other, said planar ground pattern has a tapered shape with respect to a feed point of said antenna element, and said antenna element has a cut-out portion formed at an edge portion being opposite to the planar ground pattern side of said antenna element, and said antenna element has a shape in which a bottom side thereof has a straight portion or a substantially straight portion adjacent to said planar ground pattern.

15. The antenna as set forth in claim 14, wherein a first dielectric substrate is disposed on a right upper end of said board, a second dielectric substrate is disposed on a left upper end of said board, and said planar ground pattern has a region to separate said first and second dielectric substrates.

16. The antenna as set fourth in claim 14, wherein both planes of said planar ground pattern and said antenna element are parallel or substantially parallel to each other.

17. A wireless communication device, comprising:

a dielectric substrate on which an antenna element that is conductive is formed;

a board on which said dielectric substrate is mounted, and in or on which a planar ground pattern is formed, and a RF circuitry mounted on said planar ground pattern, wherein said planar ground pattern and said antenna element do not cover each other, said planar antenna element and said planar ground pattern both contribute to radiation and are asymmetric with respect to each other, said planar ground pattern has a trimmed portion causing to continuously change a distance between said antenna element and said planar ground pattern, and said antenna element has a shape in which a bottom side thereof has a straight portion or a substantially straight portion adjacent to said planar ground pattern.

18. The wireless communication device as set fourth in claim 17, wherein both planes of said planar ground pattern and said antenna element are parallel or substantially parallel to each other.

* * * * *